US005732954A

United States Patent [19]

Strickler et al.

[11] Patent Number: 5,732,954

[45] Date of Patent: Mar. 31, 1998

[54] ROUTE RECORDING, MARKING, AND SCORING APPARATUS FOR SPORT CLIMBING WALLS

[76] Inventors: James H. Strickler, 1430 College Ave., Palo Alto, Calif. 94306; Bruce R. Kusse, 144 N. Sunset Dr., Ithaca, N.Y. 14850

[21] Appl. No.: 361,699

[22] Filed: Dec. 22, 1994

Related U.S. Application Data

[63] Continuation-in-part of Ser. No. 182,341, Jan. 18, 1994, abandoned.

[51] Int. Cl.[6] ..... A63B 9/00

[52] U.S. Cl. ..... 273/441; 482/37

[58] Field of Search ..... 434/247, 255, 434/392; 273/445, 444, 441, 440; 482/1, 7, 9, 35, 37; 364/410, 411; 463/36–47

[56] References Cited

U.S. PATENT DOCUMENTS

| | | | |
|---|---|---|---|
| 4,645,458 | 2/1987 | Williams | 434/251 |
| 4,720,789 | 1/1988 | Hector et al. | 364/410 |
| 4,974,833 | 12/1990 | Hartman et al. | 272/76 |
| 5,076,584 | 12/1991 | Openiano | 273/148 B |
| 5,125,877 | 6/1992 | Brewer | 482/7 |
| 5,256,116 | 10/1993 | Robinson | 402/37 |

*Primary Examiner*—Jessica Harrison
*Assistant Examiner*—James Schaaf
*Attorney, Agent, or Firm*—Finnegan, Henderson, Farabow, Garrett & Dunner, L.L.P.

[57] ABSTRACT

This invention comprises an electronic control system for recording, and marking hold sequences or 'routes' on structures for recreational and competitive climbing and for scoring a climber's performance in ascending such routes. When used by a climber during a new route, sensitive holds electronically transmit their identifying addresses to a computerized recording system. Upon completion of the new route climbers assign a name and grade of difficulty using the computer. Climbers may also use the computer to recall routes previously designed by others. Electronically activated markers are then used to rapidly and conveniently designate the particular holds comprising the route. As the climber ascends, the holds now function to inform the computer if the climber has used an illegal hold, that is a hold which is 'off route'. The system also keeps track of how high and how fast the climbers ascend, thus providing a convenient method of scoring their performance.

19 Claims, 12 Drawing Sheets

250
USER_ID?
251
NEW
REPEAT
INFO
QUIT
RESUME PROJECT
NEW
CANCEL
253
PROJECT_NAME?
254
INITIALIZE HOLD_ LIST
255
WRITE HOLD_LIST TO PROJECT_FILE
NEW_HOLD?
256
257
YES
258
NEW_HOLD = FALL?
TRY AGAIN
UPDATE
CANCEL
NO
ADD NEW_HOLD TO HOLD_LIST AND MARK HOLD
NO
NEW_HOLD ⊂ (TOP_HOLDS)?
259
YES
CONGRATULATIONS
260
ROUTE_NAME?
261
ROUTE_GRADE?
262
CO-ASCENSIONISTS?
263
COMMENTS?
264
ROUTE-DESIGNER SUBROUTINE, 252

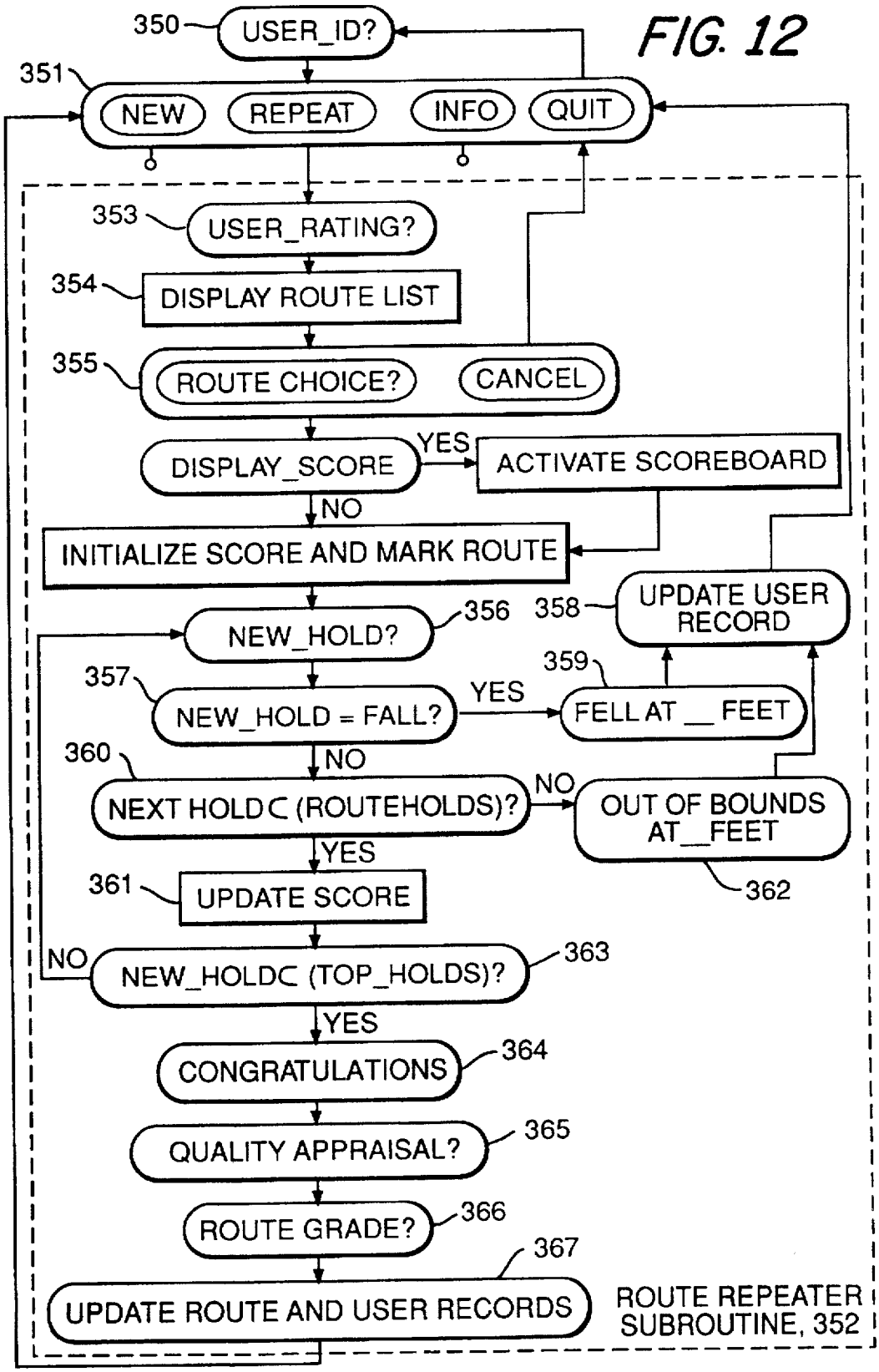
FIG. 12
350
USER_ID?
351
NEW
REPEAT
INFO
QUIT
353
USER_RATING?
354
DISPLAY ROUTE LIST
355
ROUTE CHOICE?
CANCEL
DISPLAY_SCORE
YES
ACTIVATE SCOREBOARD
NO
INITIALIZE SCORE AND MARK ROUTE
NEW_HOLD?
356
358
UPDATE USER RECORD
357
NEW_HOLD = FALL?
YES
359
FELL AT __ FEET
NO
360
NEXT HOLD C (ROUTEHOLDS)?
NO
OUT OF BOUNDS AT__FEET
362
YES
361
UPDATE SCORE
NO
NEW_HOLDC (TOP_HOLDS)?
363
YES
CONGRATULATIONS
364
QUALITY APPRAISAL?
365
ROUTE GRADE?
366
367
UPDATE ROUTE AND USER RECORDS
ROUTE REPEATER SUBROUTINE, 352

ROUTE RECORDING, MARKING, AND SCORING APPARATUS FOR SPORT CLIMBING WALLS

The present application is a continuation-in-part of application Ser. No. 08/182,341, now abandoned, filed Jan. 18, 1994.

BACKGROUND OF THE INVENTION

1. Field of the Invention

The present invention generally relates to artificially constructed structures used for recreational and competitive sport climbing. In particular, this invention relates to an electronic control system for recording and identifying routes created on artificial climbing structures, providing means for automatically scoring a competitive climber's performance while he ascends a pre-determined route on an artificial climbing structure.

2. Description of Related Art

'Sport climbing' on artificial structures has evolved from the traditional outdoor sport of rock climbing wherein climbers ascend natural boulders and rock faces. Sport climbing in gymnasiums has gained popularity because of its convenience, safety, and proximity to residential areas. Climbing gyms are equipped with artificial walls, ceilings, and caves designed to simulate naturally occurring rock features. The surface of each artificial structure is provided with 'holds' which the climber grabs, pulls on, and steps on in order to ascend or traverse between two points of the structure.

Climbers often select and make use of a particular restricted set of holds in climbing between two points of the climbing structure. Such a set of holds is commonly referred to as comprising a 'route'. New routes are frequently named by their first ascensionist, and a grade, or degree of difficulty, may be assigned from a scale of commonly understood and agreed upon subjective ratings. In the United States, sport climbing routes are graded according to the open-ended 'Yosemite decimal system' which presently ranges from an easiest rating of 5.0 to a highest difficulty rating of 5.14. A written record of the new route's name, grade, and an indication of the selected holds is sometimes preserved in a guidebook for the gym which contains a detailed map of the climbing structures. This guidebook may then be used by other climbers to locate interesting and challenging routes which impose a degree of difficulty suited to their particular skill level. The record also provides a forum for recognition of the talent, creativity, and effort of the first ascensionist.

The selected holds comprising a route may be marked directly on the wall itself, for example, by attaching pieces of distinctly colored tape nearby, or by making distinct marks with chalk. This practice makes it easier for subsequent climbers to identify which holds are 'on-route' and which holds are 'off-route' even while in the midst of climbing. However, with the passage of time, the pieces of tape tend to fall off the wall, and chalk marks become erased, so that climbers may be confounded as to how routes are possible when the remaining marked holds are so few and far between. Furthermore, in areas where there is a high density of routes using common holds, it is often difficult for a climber to identify which holds are 'on-route,' even for freshly marked routes, because of confusion with marks relating to other overlapping routes. Thus, there is a need for a system for more conveniently designating routes.

Organized climbing competition, in which climbers compete for cash awards, trophies, and prizes have become increasingly popular in recent years. Competitors are commonly judged in two categories: speed and difficulty. In the speed category, climbers generally compete on routes of lesser difficulty, and are ranked according to how quickly they complete those routes. In the difficulty category, on the other hand, climbers are ranked by how high they succeed in climbing on routes of severe difficulty. Currently, competitions are generally scored by a panel of expert referees who observe each climber and measure either the high point they attain or the time taken to complete a route. Unfortunately, this use of human judges is inefficient and provides for a possibility of human error. Thus, there exists a need for a system that objectively measures climbing performance by automatically recording hold usage and timing route completion.

SUMMARY OF THE INVENTION

Whereas there is a long-felt and as yet unfulfilled need for a system for clearly and conveniently recording and marking the holds which comprise a sport climbing route and for scoring a competitor's performance in climbing these routes:

It is an object of the invention to provide an apparatus for recreational climbing which allows the climber to electronically record a sequence of selected holds comprising a route.

It is a further object to provide an apparatus for recreational climbing which distinguishes and marks a set of pre-selected holds comprising a route, thereby allowing climbers to identify and repeat routes previously discovered by others.

It is a further object to provide an apparatus for recreational climbing which detects when holds on a wall are weighted by a climber during his ascent.

It is a further object to provide an apparatus for competitive climbing which computes, displays, and maintains a record of a climber's score on a route.

It is a further object to provide an apparatus for recreational climbing which allows dense packing of easily distinguished routes on a climbing wall.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention comprises an apparatus for automatically recording combinations of holds referred to as 'routes' used in the sport of climbing. Each hold on an artificial climbing wall has a switch or sensor associated with it that is capable of detecting when that hold is used by a climber. As a first ascensionist climbs a new route on an artificial climbing wall, each time he uses a hold he triggers the sensor for that hold, generating an electronic signal which travels down a wire to an encoding and interface circuit. This circuit, in turn, generates an encoded address corresponding to the hold which is sent to a computer or microprocessor. The computer maintains a list of the addresses of the holds used and thereby records the route. When finished climbing, the climber may enter a name for the route into the computer and assign it a grade of subjective difficulty. This information is recorded, along with the hold list, as a data file on a data storage device.

Pre-recorded routes stored in the computer memory or a data storage device may be recalled and visually displayed so that climbers may repeat routes designed by others. The climber selects a route from an index of pre-recorded route names, and the computer sends the associated list of hold addresses comprising that route to an interface and decoding circuit. This circuit then decodes the addresses and supplies power to wires connected to light emitting diodes, (LEDs), associated with the appropriate holds. The system thereby indicates the holds which are on the particular chosen route and distinguishes them from holds which are off-route or 'illegal'.

By means of the aforementioned sensors, the computer may also keep track of which holds the repeat ascensionist uses, specifically how high he climbs before falling and whether he uses any illegal 'off route' holds, thus providing an exciting new method for conveniently scoring his performance in climbing the route. The computer may also score how long he takes to complete his ascent by means of a timing mechanism for use as a method of scoring speed contests.

It is to be understood that both the foregoing general description and the following detailed description are exemplary and explanatory only and are not restrictive of the invention, as claimed.

The accompanying drawings, which are incorporated in and constitute a part of this specification, illustrate embodiments of the invention and together with the description, serve to explain the principles of the invention.

BRIEF DESCRIPTION OF THE DRAWINGS

For a fuller understanding of the nature and objects of the invention, reference should be made to the following detailed description and the accompanying drawings, in which:

FIG. 12 is a schematic diagram depicting a control program subroutine illustrative of the invention.

DESCRIPTION OF THE PREFERRED EMBODIMENTS

Reference will now be made in detail to the present preferred embodiments of the invention, examples of which are illustrated in the accompanying drawings.

Figure 1:
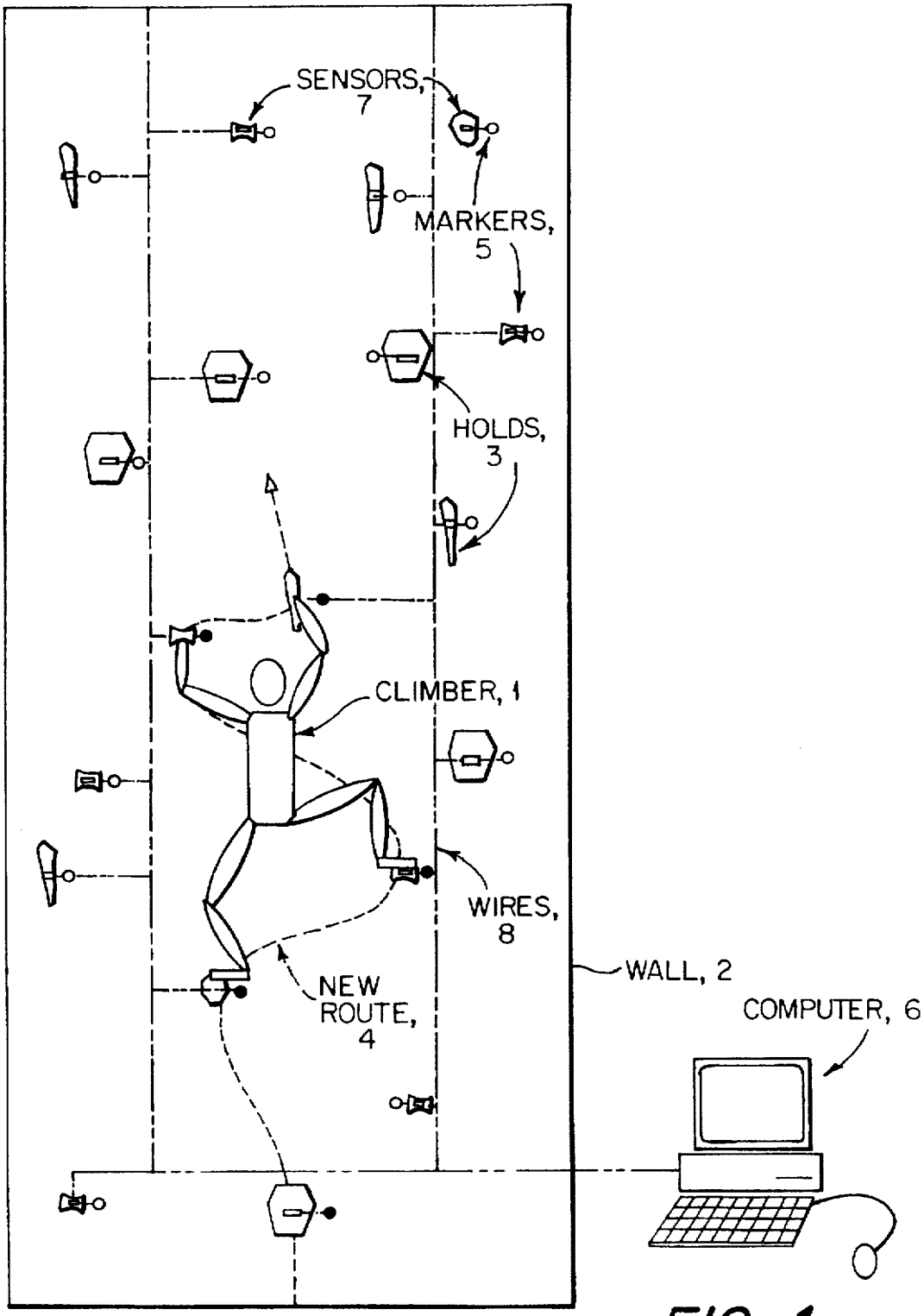
FIG. 1 is a schematic diagram illustrating the general structure and function of the invention in its route designer mode.
Figure 2:
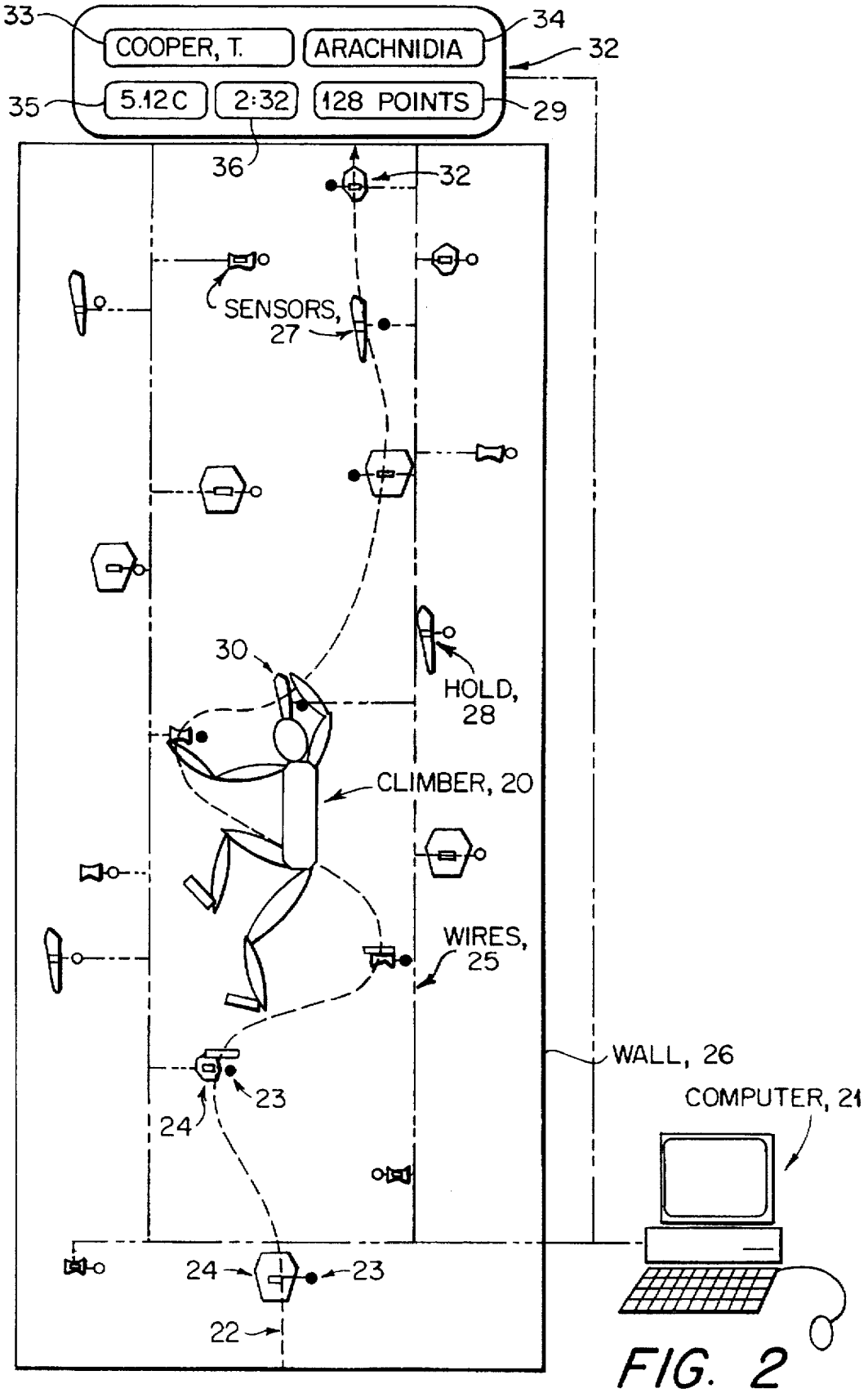
FIG. 2 is a schematic diagram illustrating the function of the invention in its route repeater mode.

FIGS. 1 and 2 illustrate the general purpose, structure and function of the invention. The invention has two distinct modes of operation: (1) 'route designer mode' in which the device records new or original routes as they are created by the user, and (2) 'route repeat mode' in which the device indicates to the user a group of holds comprising a selected route which has been pre-recorded by an earlier user.

Route Designer Mode

FIG. 1 shows the invention operated in the route designer mode. A climber 1 is shown climbing on a portion of a wall 2 by grasping and stepping on the holds 3. In his ascent, the climber 1 selects a particular subset of the holds 3 out of the totality of available holds and thereby composes a new route as indicated by the dashed line 4.

According to the invention, each hold, is assigned a unique binary encoded address. During the composition of a new route, a list of the addresses of the holds which are on that route is compiled by a computer 6.

In the preferred embodiment of the invention, each of the holds 3 is equipped with a sensor 7 which detects when that particular hold is used by the climber 1, and informs the computer 6, which thus, records the identities of the hold 3 which are 'on-route' as they are used.

In the preferred embodiment, the sensors used to detect which holds are used are simple mechanical switches located behind the holds which detect motion of the hold when it is weighted by the climber. Alternately, the sensors may be heat detectors, detecting the body heat of the climber; optical sensors, detecting blockage of light by the climber; capacitance detectors or inductance detectors, which detect the change in electrical impedance produced by a climber; pressure detectors, including piezo-electric devices; sonic transducers, which detect either the sound produced by the climber or the impedance of sound by the climber. Other types of sensors are possible, and it is not intended for the invention to be limited to any particular type.

It is noted that for the invention to operate in the route recording mode the switches do not need to be on the wall itself, but rather may be located on a ground based control panel. This panel may be operated by a person who observes which holds the climber uses and triggers the associated switches during the ascent. Alternately, the climber may enter the hold identities himself after he has returned to the ground. It is furthermore noted that the control panel may simply be the keyboard of the computer itself, and that the hold identities may simply be entered as keystrokes.

In the preferred embodiment, the invention provides a set of hold markers 5, one adjacent to each of the holds 3, whose appearance are changed as their corresponding holds 3 are used by the climber 1 in the ascent of the new route 4.

For example, the hold markers 5 may be lights such as light emitting diodes (LEDs), which are illuminated to indicate that their corresponding holds are on-route. Alternately, the markers may be flags which are flipped between two distinguishable configurations electromechanically, for example by passing a current through a solenoid coil wrapped around the shaft of a flag. Switches for the electronically controlled route markers may be adjacent to the holds themselves or they may be located on a ground based control panel. In the preferred embodiment, however, the switching of the hold markers is controlled by a computer 6, as described more fully below.

Once the ascent of a new route is complete, the climber may also record on the computer 6 the 'route information,' such as: a name chosen for the route, its grade of difficulty, the names of any others who assisted in composing the route, and comments related to the route. The computer 6 stores this information in a data file along with the date and time of the name of the completed ascent, and the name of the 'principle first ascensionist'. This information is used by other climbers in selecting routes to practice climbing on or to compete on as explained in detail according to the description of FIGS. 2 and 8.

Even if the climber 1 fails to complete the route 4, he may choose to instruct the computer 6 to record route information along with the list of holds as a 'project' or 'route in progress'. The controlling program is structured such that a project must be climbed without falling, before its status could be changed to that of a completed route. The climber 1 may use the computer 6 to call up a route in progress to continue working on it. The computer 6 will then mark the holds which had previously been used so that the climber may attempt to complete the route from his high point. A climber's routes in progress may be 'password protected' from being attempted by others, thus allowing the climber to work on new ascents at his leisure, without the fear that the first ascent of his potential route will be preempted.

Route Repeat Mode

FIG. 2 shows the use of the invention in its route repeat mode. The climber 20 first uses the computer 21 to select a route, as indicated by the dashed line 22, from a prerecorded list of routes. The computer 21 provides power to hold markers 23 associated with the particular holds 24 of the selected route 22 through wires 25, hidden behind the surface of the wall 26, thereby indicating to the climber 20 which holds are on-route. For example, hold markers 23 may be lights such as LEDs which are illuminated, or rapidly flashed, to indicate that their corresponding holds are on-route. Alternately, the markers may be flags which are flipped between two distinguishable configurations electromechanically, for example by passing a current through a solenoid coil wrapped around the magnetic shaft of a flag post.

Hold markers 23 are preferably placed to the side of their respective holds 24 rather than above or below the holds. This ensures that the markers are easily visible to the climber both from above the hold as well as from below the hold. This is important for large holds which may, for example, obscure a light placed below the hold from the climber's view when he has climbed above it.

As described above, the wall 26 may be equipped with a network of sensors 27 which inform the computer 21 which holds the climber 20 uses. If the climber applies weight to a hold 28 which is 'illegal' or 'off-route,' its associated sensor sends a signal to the computer, which may then alert him that he is 'cheating,' for example by resetting all hold markers or sounding a buzzer.

Score Keeping

As described above, and more thoroughly in description of FIG. 12, the computer 21 furthermore records a list of holds which the climber 20 uses in his ascent for the purpose of scoring his climbing performance. Each time the climber grabs a new hold, a signal is sent to the computer 21 by means of the associated sensor. The computer may thus award points for reaching progressively higher holds on the route.

In one simple scoring method, the climber's score 29 is simply the height of the highest hold 30 he has weighted. Alternately, the climber's score 29 may be calculated in a more complicated fashion taking into account the difficulty of the moves between the holds. In other words, a specific point value would be added to the climber's score for reaching each hold depending on the subjective degree of skill required to reach that particular hold.

The computer 21 may also record the time required by the climber to complete the ascent for the purpose of judging a speed climbing contest. This is easily done, for example, by measuring the time elapsed between the instant the climber weights the first hold 30 and the instant when he activates a route completion detector, which may be in the form of a button he would push, or a cord he would pull, or more simply the sensor associated with a final hold 31.

The climber 20 may elect to have his score 29 posted on a display panel 32 along with his name 33; the route name 34; its grade of difficulty 35; and his elapsed time on the route 36.

These features of the invention which foster competition are perceived as being important. Climbers tend to be very competitive individuals who enjoy being challenged and whose egos respond positively to having quantitative calibrated measurement of their skill and performance. This invention provides a convenient means of calculating and comparing performance and skill of different climbers and allowing climbers to compete with each other even without organized events. A climber can simply go to the gym and workout on a few routes and receive a record of his 'score' which he can then report to his friends much as a golfer or bowler might report a particular satisfying round or game.

Grade and Quality Confirmation

After completing a route the climber 20 is requested by the computer 21 to rate the difficulty and quality of the route. This information along with the name of the climber, and the date and time of ascent, is added to a data file which tracks the daily climbing activity on the wall. Information from this file is later incorporated into a database for the gym, thus allowing routes which were initially incorrectly graded by their first ascensionist to be re-graded if subsequent climbers disagree with the original rating. The route quality rating information is published so that other climbers will be alerted to routes which have been found to be particularly enjoyable. Further, the quality rating serves as a method of praising first ascensionists whose routes are unusually innovative and interesting to climb.

Even if the climber falls before completing his ascent, the computer 20 may record his performance data for later incorporation into the gym's database as a means of evaluating the climber's ability and of appraising the difficulty of the route.

The climber 20 may also request the computer 21 to display (or print out) his record of ascents, listing the routes he has climbed by name, grade, date, and by the number of attempts taken to complete each route. The climber 20 may also request the computer 21 to display (or print out) his rank within a league of climbers, or his skill ratings which may be calculated based on his recent climbing history. For example, the climber 20 may have a 'flash' rating comprising the average grade of his ten most difficult flash ascents of the last six months. A 'flash ascent' refers to a complete ascent of a route on the first attempt without falling. A 'general' rating for the climber 20 may be comprised of an average of his ten most difficult recent ascents, without regard to how many attempts he required to complete the routes.

These climbers' skill ratings are analogous to the golfers' handicaps or the bowlers' game averages, and are also expected to enhance the popularity of the sport because of their appeal to the participants' egos. Thus, the capability to conveniently compile information about climbers' performances and calculate ratings is an important feature of this invention.

Fall Detection

Figure 3A:
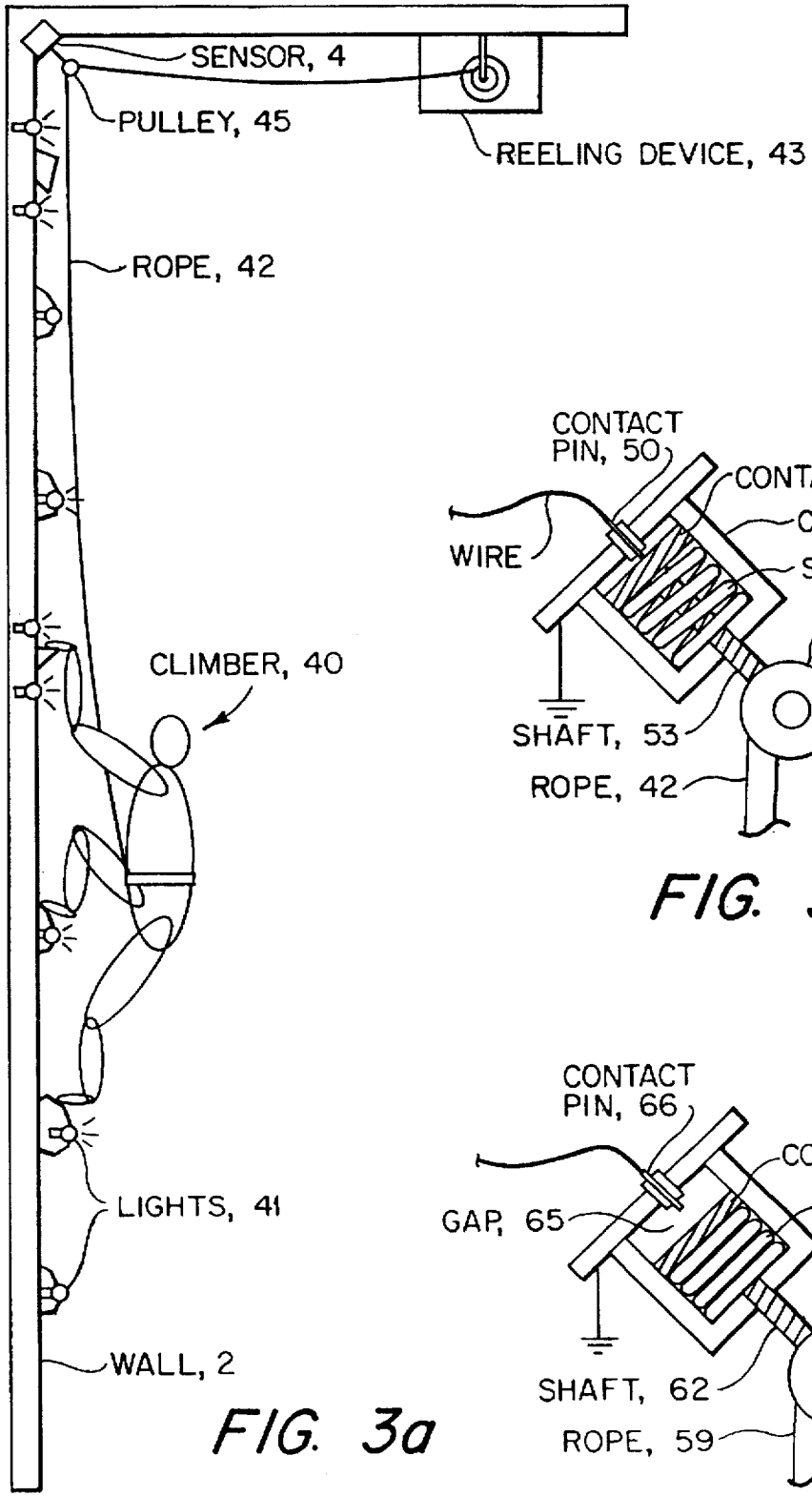
FIGS. 3*a*, 3*b*, and 3*c* are schematic diagrams depicting a fall detection sensor illustrative of the invention.
Figure 3B:
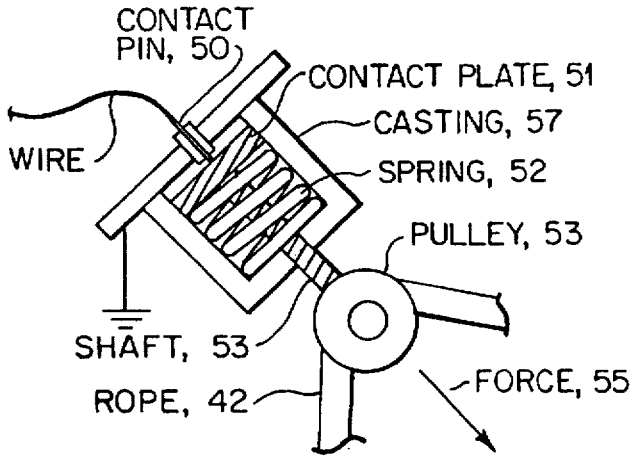
Figure 3C:
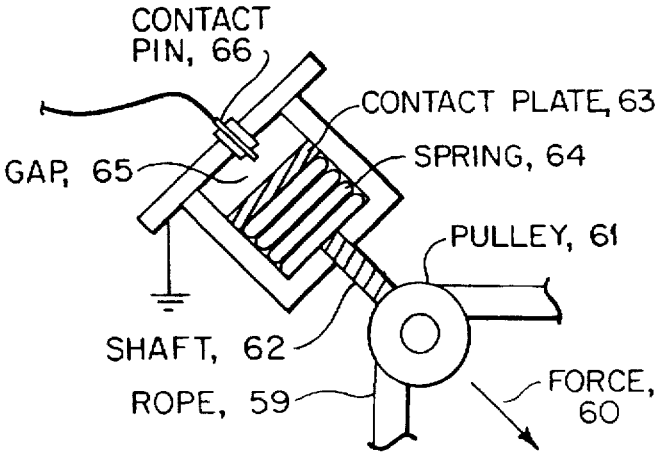

FIGS. 3*a*, 3*b*, and 3*c* are schematic diagrams depicting a fall detection sensor illustrative of the invention. Such a sensor is a valuable option useful in scoring the climber's performance by sending a signal to the computer if and when the climber falls.

In FIG. 3*a* a climber 40 is shown ascending a route marked by lights 41, as described above. The climber 40 is protected from injury by a rope 42 and reeling device 43 designed to control his descent in the event that he should fall. This device is described in U.S. patent application No. 08/166,045 entitled "Sport Climbing Safety Device" filed by James H. Strickler on Dec. 14, 1994, which is incorporated herein by reference. In the present invention, the reeling device 43 is additionally equipped with a sensor 44 which detects the increase in tension in the rope when the climber falls, and sends an electronic signal down a wire to the computer. The sensor 44 may, for example, be a simple electronic switch which is associated with a pulley 45 which serves as a turning point for the rope 42.

FIG. 3*b* shows a simple example of such a switch in the closed position before the climber 40 of FIG. 3*a* has fallen. The electrical contacts 50 and 51 are pressed together by a coil spring 52, which supports the lower contact plate 51, the attached shaft 53, and pulley 54, against the force 55 associated with the light tension in the rope 56. The spring is enclosed in a grounded casing 57, which in turn grounds the contact 51.

FIG. 3*c* shows the switch in the open state due to the increased tension in the rope associated with the climber's fall. This increased tension exerts a force 60 on the pulley 61 and attached shaft 62 and contact plate 63 thereby compressing the spring 64, and opening a gap 65 between the contacts 63 and 66.

Alternately, the fall detection device 43 may be equipped with an encoder circuit which reports to the computer the length of climbing rope which has been reeled in. This length may then be compared by the computer with the height of the climber as determined by the weight sensors to form a safety interlock system. For example, if the two distances thus measured did not match to within a few feet, indicating that slack had developed in the climbing cord, or that perhaps the climbing cord was not properly attached to the climber, an alarm could be sounded, warning the climber to descend promptly using the largest holds available.

Circuit Diagram

Figure 4:
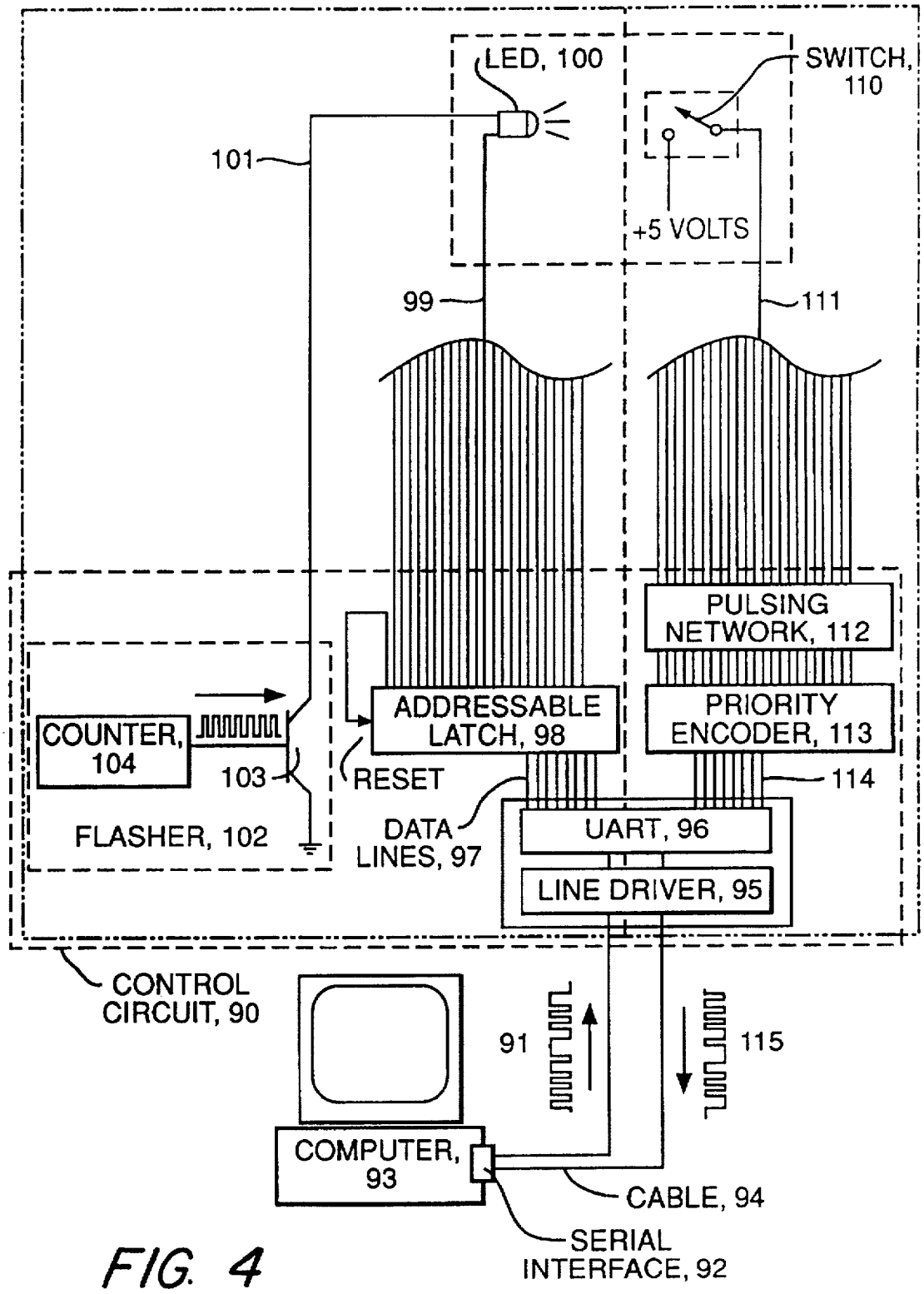
FIG. 4 is a schematic diagram depicting an electronic circuit illustrative of the invention.

FIG. 4 is a schematic diagram depicting an electronic circuit illustrative of the invention. The control circuit 90 receives binary encoded hold addresses 91 from the serial interface 92 of a computer 93 across a cable 94 which is terminated at a line driver module 95. The serially encoded address 91 is transmitted by the line driver module 95 to the input of a universal asynchronous receiver/transmitter (UART) 96, which effects a serial to parallel conversion so that each address bit is represented one of a set of data lines 97. These data lines 97 transmit the hold address to an addressable latch 98 which supplies voltage to the appropriate output line 99, thereby illuminating the LED 100 associated with the addressed hold. By sending a series of addresses for the holds defining a route, a control program on the computer 93 instructs the electronic control circuit to light each of the appropriate LEDs, thereby indicating the route to the climber.

In the preferred embodiment of the invention, the LED 100 is flashed in order to render it more easily visible to the climber. This is efficiently accomplished by periodically opening the path to ground from the efferent lead 101 of the LED 100 using a flasher module 102, for example, comprising a transistor 103 and counter/timer chip 104.

One of the binary address codes available to the controlling computer program is reserved as a reset command. When this command is issued by the controlling program on the computer 93, the addressable latch 98 is reset, thus turning off all of the hold marking LEDs.

When a switch 110 associated with a particular hold, is closed by action of the climber's use of the hold, then its line 111 receives voltage. This line 111 leads to a pulse forming module 112 which sends a voltage pulse to a corresponding input of a priority encoder circuit 113 which in turn sends the address of the hold, across a set of data lines 114 to the transmitting side of the UART 96. The UART 96 then effects a parallel to serial conversion, and transmits the serially encoded address 115 through the line driver module 95, down the cable 94, through the serial interface 92 of the computer 93. The control circuit 90 thus informs the control program on the computer 93 that a hold has been used by the climber and the program adds the address of the hold to the list stored in memory of the holds which define the route.

The pulse forming module 112 may comprise a set of parallel one-shots or band-pass filters. It serves both to debounce the switches and to ensure that pulses from different holds do not temporally overlap at the priority encoder 113. This ensures that the signal from a hold having a low priority address is not masked by that from a hold having a higher address.

Note that in the preferred embodiment of the invention one of the hold address lines 114 is connected to the fall detection apparatus of FIG. 3.

It is noted that this figure is intended merely to illustrate one of many possible electronic control configurations for accomplishing the generic aspects of the invention, that is marking the holds and detecting their use. For example, the control circuit which is shown as detached from the computer in FIG. 4, may alternately be a printed circuit board contained within the computer case itself. In a preferred embodiment, the electronic circuit is interfaced through the parallel (printer) port of a PC compatible computer, and not through the serial port. A circuit as shown on page 196 of the Oct. 10, 1991 issue of Electronic Design News may be used to expand the capacity of this port.

Furthermore, what is shown on FIG. 4 as a microcomputer can be conveniently replaced with a microcontroller, or custom designed VLSI circuit once large scale production is desired, thereby reducing the cost of the system. An inexpensive keypad and a cheap and compact liquid crystal display may then be used in place of the keyboard and cathode ray tube shown in this figure.

It also may be desirable under certain circumstances to spatially distribute the logic components behind the surface of the climbing wall so that less wire may be used. Alternately, a wire matrix may be used to address holds, which would even further reduces the quantity of wire required as described below.

Matrix Circuits

Figure 5A:
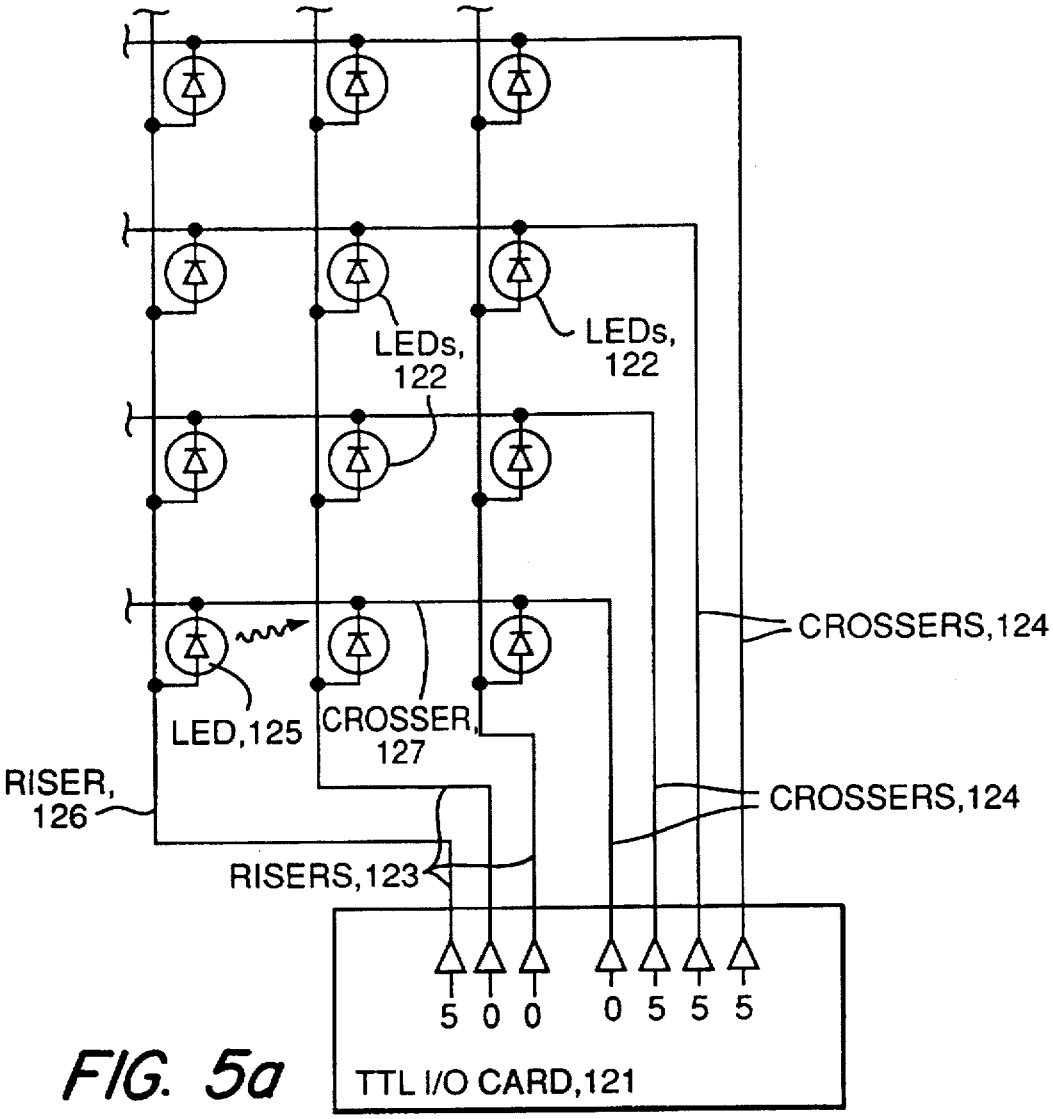
FIG. 5*a* is a schematic diagram depicting an improved electronic circuit for powering hold indicator lights illustrative of the invention.
Figure 6:
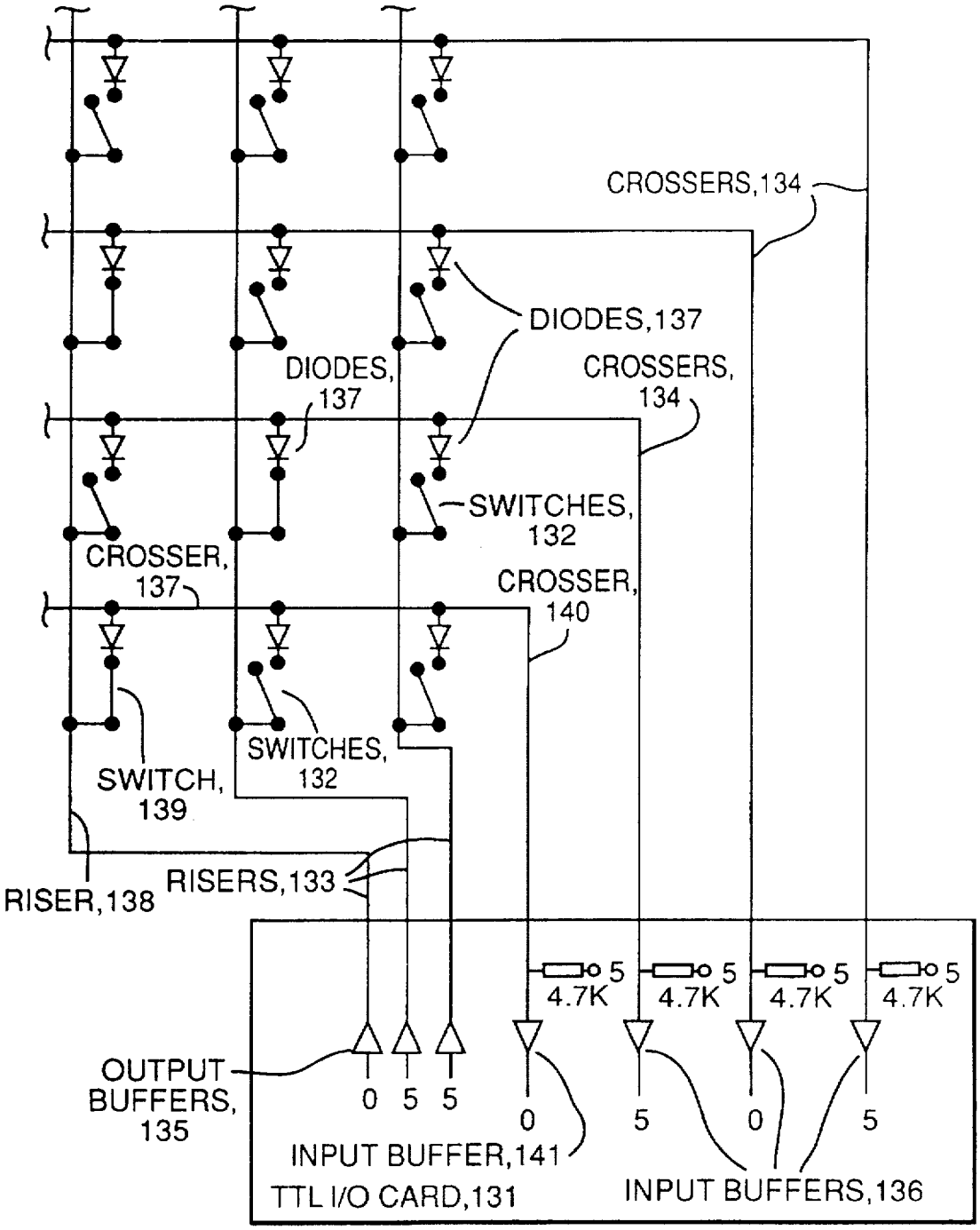
FIG. 6 is a schematic diagram depicting an improved electronic circuit for interrogating weight sensor switches illustrative of the invention.

In order to reduce the quantity of wire required to implement the invention and simplify its manufacturing, it is preferred to arrange the indicator lights and sensor switches on a pair of grids or matrices as shown in FIGS. 5*a* and 6. Each component, either a switch or an LED, is placed at the intersection of two wires, one wire being a member of a set of 'risers' which run vertically up the wall, and the other wire being a member of a set of 'crossers' which run laterally across the wall.

FIG. 5*a* shows how the array of LEDs may be controlled by a standard TTL I/O card 121, for example, a model 2201 sold by Circuit Specialists of Tempe, Ariz. Each of the LEDs 122 is located at the intersection of a pair of wires, one from a set of risers 123, and the other from a set of crossers 124. When all the risers are held low, at 0 Volts, and/or when all the crossers are held high at +5 Volts, none the LEDs will emit light. In order to power a particular LED 125 and cause it to emit light, both its corresponding riser 126 must be raised high to 5 Volts, and its corresponding crosser 127 must be dropped low to 0 Volts. All of the LEDs associated with on-route holds within a particular column may be lit simultaneously by dropping the corresponding set of crossers low, to 0 Volts, while holding the corresponding riser high, at 5 Volts.

Figure 5B:
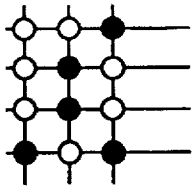
FIGS. 5*b*–5*e* are diagrams illustrating the operation of the circuit depicted in FIG. 5*a*.
Figure 5C:
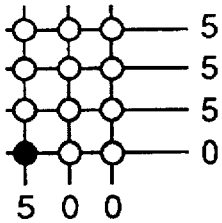
Figure 5D:
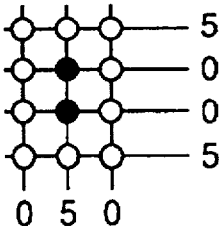
Figure 5E:
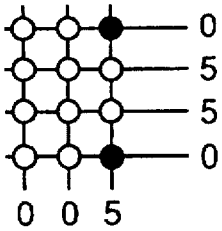

According to the preferred embodiment of the invention, all of the LEDs associated with the holds of a particular route may be flashed by sequentially raising each of the risers high, to 5 Volts, while simultaneously dropping the appropriate sets of crossers low, to 0 Volts. For example, the pattern of holds indicated by the darkened circles of FIG. 5*b* is produced by successively applying the voltage patterns shown in FIGS. 5*c*, 5*d*, and 5*e*. This pattern of voltages is rapidly repeated iteratively at about 5 Hertz to indicate to the climber which of the holds are on route.

It is noted that the duty cycle, that is the percentage of time each LED spends in the lit state, is given by the reciprocal of the number of risers, since only one riser may be raised at a time. Therefore, it is important that the number of risers not be too large or the LEDs will not emit enough light to be easily seen. Therefore, no more than six to eight riser wires per set of crossers are preferred for the present invention.

FIG. 6 shows how the array of weight sensing switches may be interrogated by a standard TTL I/O card 131, for example, a model 2201 sold by Circuit Specialists of Tempe, Ariz. Each of the switches 132 is located at the intersection of a pair of wires, one from a set of risers 133, and the other from a set of crossers 134. The risers 133 are terminated at a set of TTL output buffers 135 on the I/O card 131 and the crossers 134 are terminated at a set of input buffers 136. When all the output buffers 135 of the risers 133 are held high, at 5 Volts, then no current will flow through the diodes 137, and the input buffers 136 will see 5 Volts across 4.7 kilo-ohm resistors as shown. In order to interrogate a particular column of switches, for example, the leftmost column shown in the figure, their riser 138 is dropped low to 0 Volts. If a particular switch 139 has been closed by a climber's weight on its hold, then current will flow through its associated crosser 140 pulling the voltage at its associated input buffer 141 low.

To determine which holds are weighted, the invention uses the I/O card to successively drop the voltage on each of the risers and simultaneously read the voltages on the associated input buffers. Using a standard 40 MHz 386 series personal computer (PC), it is possible to read out the states of each of 144 switches many times per second.

It is noted that the diodes 137 are necessary to prevent undesirable currents from disrupting the proper function of this circuit.

It is noted that the risers 126 of FIG. 5*a* used to power the LEDs, and the risers 138 of FIG. 6 used to interrogate the switches may be physically the same, so long as all the crossers, 124 of FIG. 5*a* used to drain the LEDs are held high during the switch interrogation cycle.

The matrix wiring method drastically reduces the number of conductors and driving latch circuits required to implement the invention. For example, using a conventional circuit in which each LED and each switch has its own separate line, a sport climbing wall with 144 holds would normally require 144 active wires to power its LEDs, 144 active wires to interrogate its switches, plus a ground wire for a total of 289 conductors (and 288 latch circuits). However, using a matrix scheme, only 24 crossers are required for the LEDs, 24 crossers are required for the switches, and only 6 risers are required (if used for both the switches and the LEDs), for a total of 54 wires and 54 latches required in total.

Lights and Switches

For the invention to function properly each hold's sensor must reliably detect each time a climber applies his or her weight to the hold, and must not give false registrations when the climber is not using that particular hold. A preferred method for detecting the climber's weight uses normally open push-button switches placed behind the back surface of the hold as shown in FIGS. 7 and 8.

Figure 7:
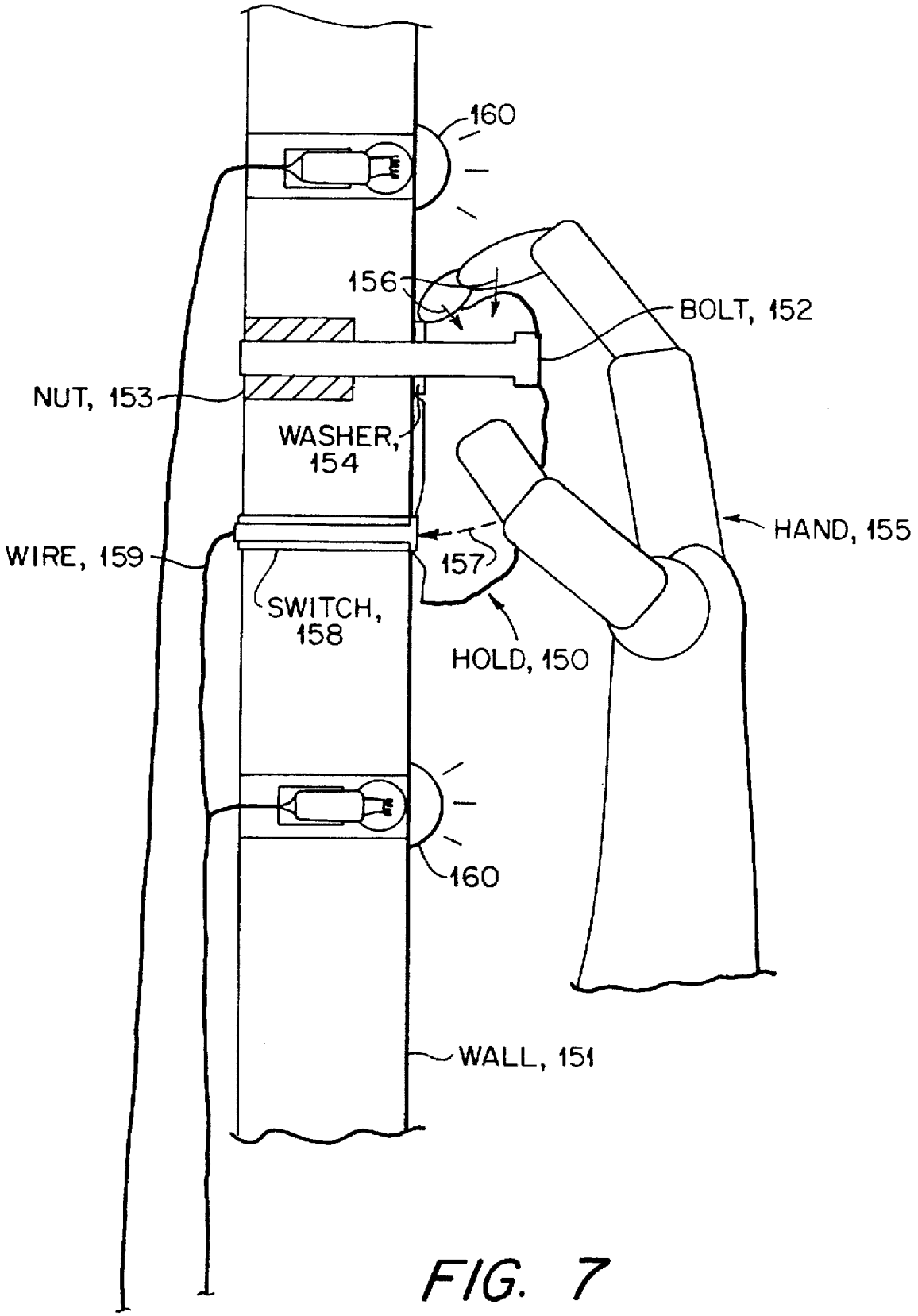
FIG. 7 is a schematic diagram depicting a sensor and hold illustrative of the invention.

FIG. 7 is a schematic diagram depicting a sensor and hold illustrative of the invention. The hold 150 is attached to the wall 151 by means of a bolt 152 and a nut 153 and a washer 154. A climber's hand 155 is shown in a typical position pulling downward and outward on a hold 150. The force exerted on the hold by the climber's hand is indicated by the arrows 156. The washer 154 is made of a flexible material such as rubber or nylon, so that when force is applied by the hand the hold moves slightly, as indicated by the dashed arrow 157, thereby activating the push button switch 158 and sending a signal down the wire 159.

Also shown is a pair of illuminated lights 160 indicating that the hold is 'on-route'.

Figure 8A:
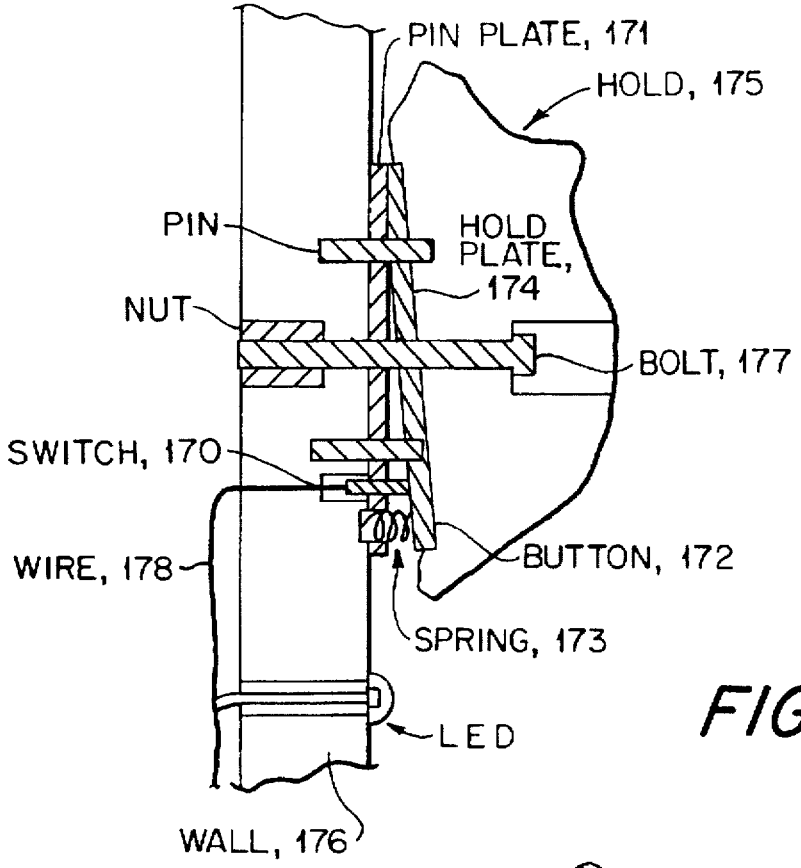
FIGS. 8*a* and 8*b* are schematic diagrams depicting a sensor mechanism and hold illustrative of the invention.
Figure 8B:
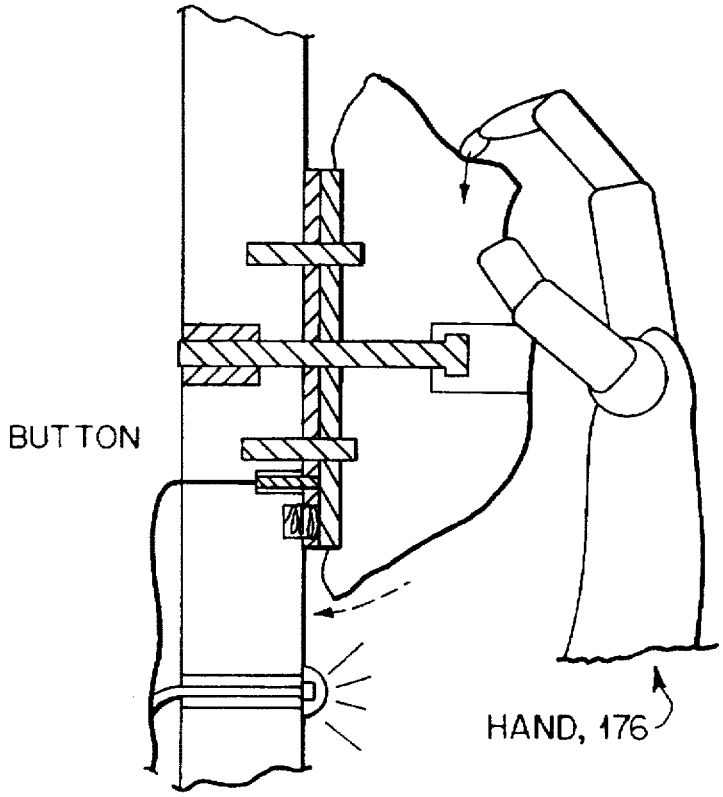

In the preferred embodiment of the invention shown in FIGS. 8*a* and 8*b*, the push-button switch 170 is affixed to the back side of a steel pin plate 171 with its button 172 projecting slightly through a hole in the plate. A small compression spring 173 passes through a hole in the pin plate 171 and applies force to a hold plate 174, which is affixed to the back surface of the hold 175. The hold 175 is held against the wall 176 by a bolt 177 which is loose enough to allow the spring to push the bottom of the hold away from the wall slightly so that the switch rests in the open state.

Figure 9:
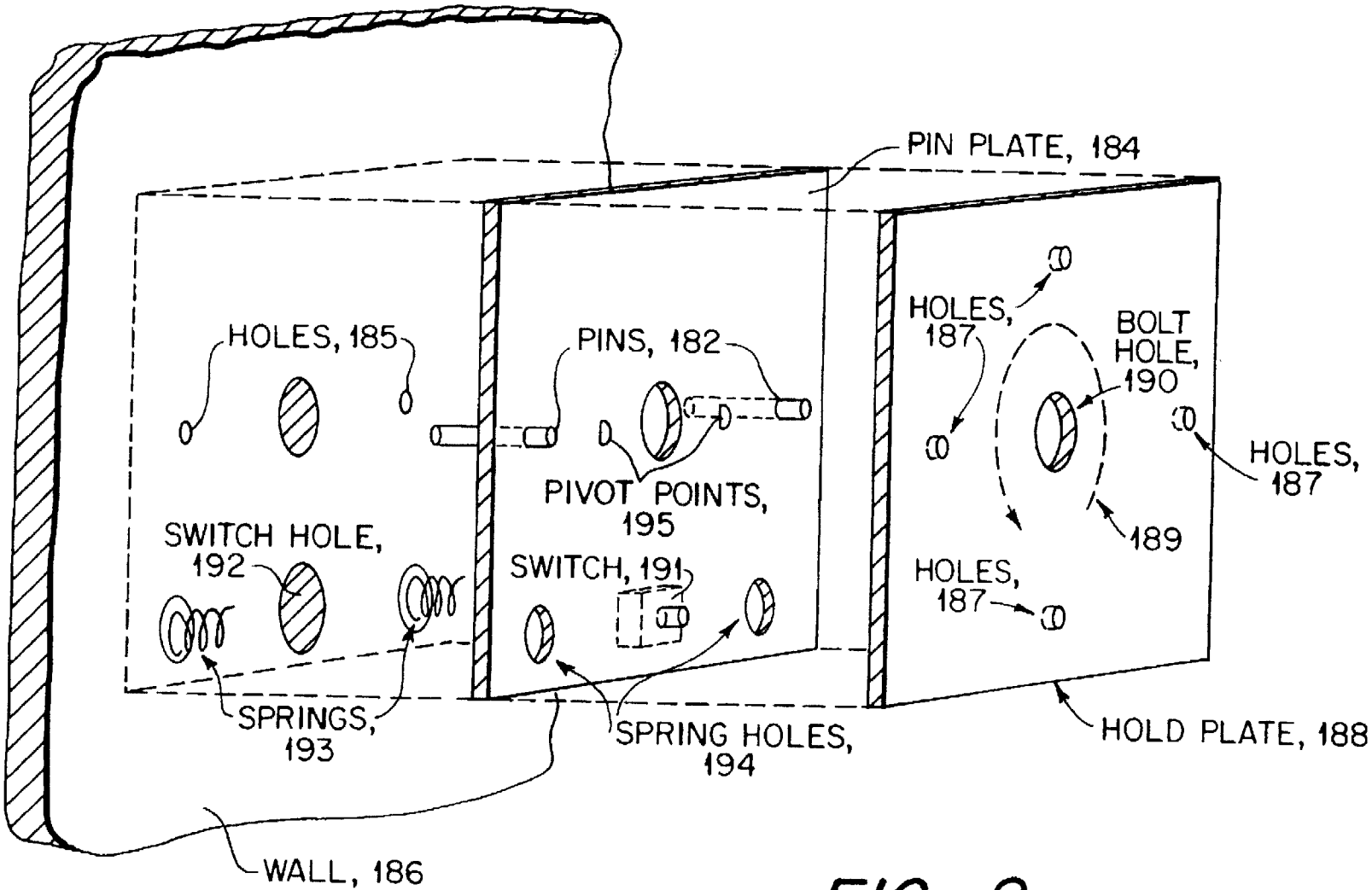
FIG. 9 is a schematic diagram showing mechanical components of a sensor mechanism illustrative of the invention.

When the climber either steps on the hold 175 or grabs it with his hand 176, as shown in FIG. 8*b*, the spring 173 is compressed and the hold 177 is forced flat against the wall, thereby pushing the button 172 of the switch 170 and sending a signal down the wire 178 which passes out the back of the wall 176 down to the computer of FIGS. 1 and 2. The hold 175 may pivot about the upper edge of the pin plate 171 as shown, or alternately about a pair of pivot points formed in the surface of the pin plate as shown in FIG. 9. A pair of dowel pins 179, which may be formed of steel, serve to prevent the hold 175 from spinning about its bolt 177. The pins may be positioned one above the other as shown in FIGS. 8*a* and 8*b*, or in the preferred embodiment illustrated in FIG. 9, they may be placed side by side.

It is noted that the length of the button 172, which projects beyond the surface of the pin plate 171, need actually only be slightly longer than the throw of the switch 170, e.g., for an Alco model FSM-1, about 12 thousands of an inch.

It is also noted that the pin plate may be affixed to the surface of the climbing wall using epoxy or screws, the body of the switch fitting into a cavity counterbored into the wall's surface as shown.

The hold is bolted to the wall using a bolt 170 and a nut 180 located on the back side of the wall. In order to allow the invention to operate properly the bolt is first screwed down tightly and then unscrewed slightly in order to allow the spring to push the bottom of the hold away from the wall creating a gap between the plates 171 and 174, and allowing the switch 170 to open its circuit. The gap shown in the figure is greatly exaggerated for clarity of illustration. In the preferred embodiment of the invention, the gap is normally only about 12/1000ths of an inch.

The design and relationship of the pin plate and hold plate are further illustrated in FIG. 9.

For conventional climbing walls the strong normal force of the hold against the wall which is supplied by the head of the bolt prevents the holds from spinning about their bolts when torque is applied by the climber's weight. Since for the invention described herein the bolt is required to be less tight than for conventional climbing walls in order to allow the weight sensing mechanism to operate, it is necessary to provide a means of preventing the hold from spinning. This is effectively accomplished by means of anti-rotation pins 182 press fitted into holes formed within the pin plate 184. These pins slip into a pair of complementary holes 185 drilled in the wall 186 to which the plate is affixed. The pins 182 also fit into a set of complementary holes 187 formed within the hold plate 188 (which is attached to the back surface of the hold as shown in FIG. 8*a*). The pins 182 thus prevent the hold plate and the attached hold, (not shown) from rotating in the direction indicated by the dashed arrow 189. It is preferred to use at least two pins, and to locate them equidistant on opposite sides of the bolt hole 190.

For conventional climbing walls it is possible to rotate a hold to any particular angular orientation about the axis of the bolt before tightening its bolt allowing it to be positioned for use as a 'aside pull,' an 'undercling,' or a 'downward pull'. In order to allow the holds of the present invention to be positioned in a variety of angular orientations about their bolts, multiple pairs of holes 187 are located around the bolt hole 190 of the hold plate, 188. For example, the plate 188 of FIG. 9, which is shown with two pairs of holes 187, may be positioned in four angular orientations about the bolt. It is noted that the number of pairs of holes 187 may be much larger than that indicated in this figure.

FIG. 9 also shows the switch 191 which is affixed to the back side of the pin plate 184; the switch hole 192 which is counterbored into the wall 186; and springs 193 also counter sunk into holes formed within the wall 186. As indicated in FIGS. 8*a* and 8*b* above, these springs pass through holes 194 in the pin plate 184 and press on the hold plate 188. A pair of pivot points 194 provide a fulcrum for the hold 175 of FIG. 8*a* to pivot about when the climber applies weight. These points may be formed, for example, using a hammer and punch.

Control Software

Figure 10:
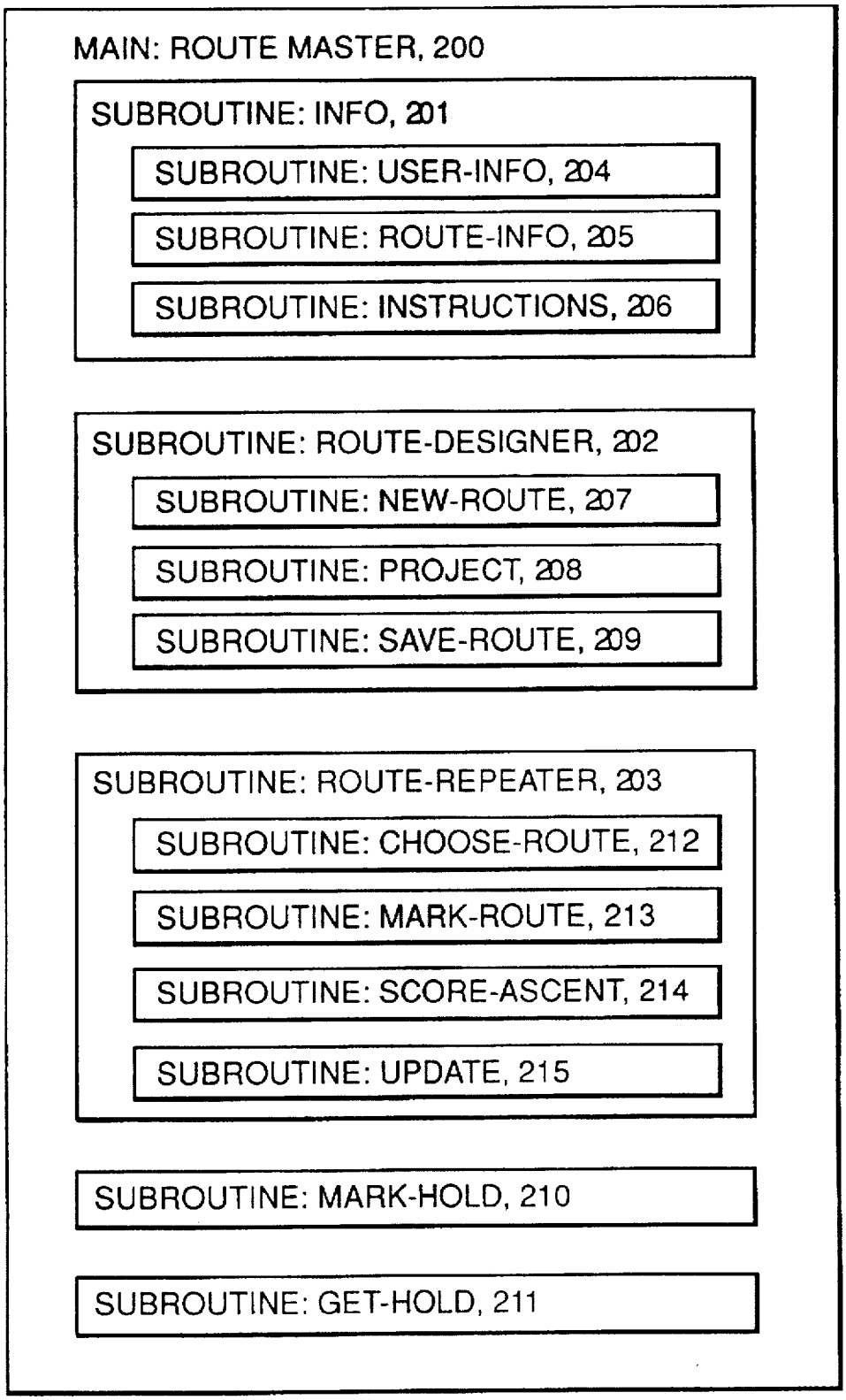
FIG. 10 is a schematic diagram depicting a control program structure illustrative of the invention.

FIG. 10 is a schematic diagram depicting a control program structure illustrative of the invention. Following the user's request the main program module, 'route-master' 200 calls one of three principal subroutines: 'info' 201; 'route designer' 202; and 'route-repeater' 203.

The info subroutine 201 provides access to information on users of the climbing wall facility by calling a subroutine 'user-info' 204, access to information on routes by calling a subroutine 'route-info' 205, and access to instructions by calling a subroutine 'instructions' 206.

The user-info subroutine 204 may display a list of climbers sorted alphabetically by name, or ranked by skill rating, or by number of first ascents etc.

The user-info subroutine 204 may also provide access to an individual user's climbing record, which contains summary information such as: the number of first ascents, the average quality rating given by others to these first ascents; the number of times the climber's first ascents were repeated by other climbers; the number of routes completed by the climber; and ratings of the climber's skill level as calculated by varied criteria. For example, the climber may be given a 'maximum difficulty rating,' calculated as the average grade of his five most difficult ascents within the last thirty days; a 'flash rating,' calculated as the average grade of the five most difficult flash ascents of his last 50 attempts; a 'fall-proof threshold,' calculated as the highest grade below which the climber has not fallen; a 'speed rating,' calculated as the average time required to climb routes of two grades easier than his maximum grade.

Along with the summary information the info subroutine may additionally display a climber's history, that is a list of routes completed sorted by reverse chronology and including: the date of completion, the route name, the difficulty grade, and the number of failed attempts before completion. The info subroutine may also present, upon request, a list of a user's first ascents, including the grade, date of completion, quality rating, and number of repeats ascents.

The route-info subroutine 205 provides route information including a general index to routes which may be listed by various criteria such as date of completion, grade of difficulty, quality rating, and first ascensionist name. The route-info subroutine may also list the ascent history of a particular route, providing the names of climbers having completed its ascent, their grade at the date of ascent, the number of failed attempts before completing the ascent, and the date and time when they completed the ascent. This information is useful for maintaining consistent grading of routes. For example, if many climbers having a rating of say 5.10a were to succeed in climbing a route graded 5.11d then the route could be downgraded accordingly. Route grades may be determined in a number of different methods. The traditional method of trusting the judgment of the first ascensionist often leads to errors in grading which may frustrate subsequent climbers. A better method seems to be to use the average grade proposed by all the repeat ascensionists.

The instructions subroutine 206 simply provides instructions to new users of the climbing facility on the use of the subject of this invention: the route recording, marking, and scoring apparatus.

The route-designer subroutine 202 is called by the main program 200 at the request of a climber wishing to design a new route or resume work on a 'project route'. This subroutine 202 makes calls to five further subroutines: 'new-route' 207; 'project' 208; 'save-route' 209; 'mark-hold' 210; and 'get-hold' 211. The operation of the route-designer subroutine 202 and its subordinate subroutines is illustrated further in FIG. 11 and described in the accompanying text.

The route-repeater subroutine 203 is called by the main program 200 at the request of a climber wishing to repeat a route which was designed earlier. This subroutine 203 makes calls to five further subroutines: 'choose route' 212; 'mark-route' 213; 'score-ascent' 214; 'update' 215. The operation of the route-repeater subroutine 203 and its subordinate subroutines is illustrated further in FIG. 12 and described in the accompanying text.

Route-Designer

Figure 11:
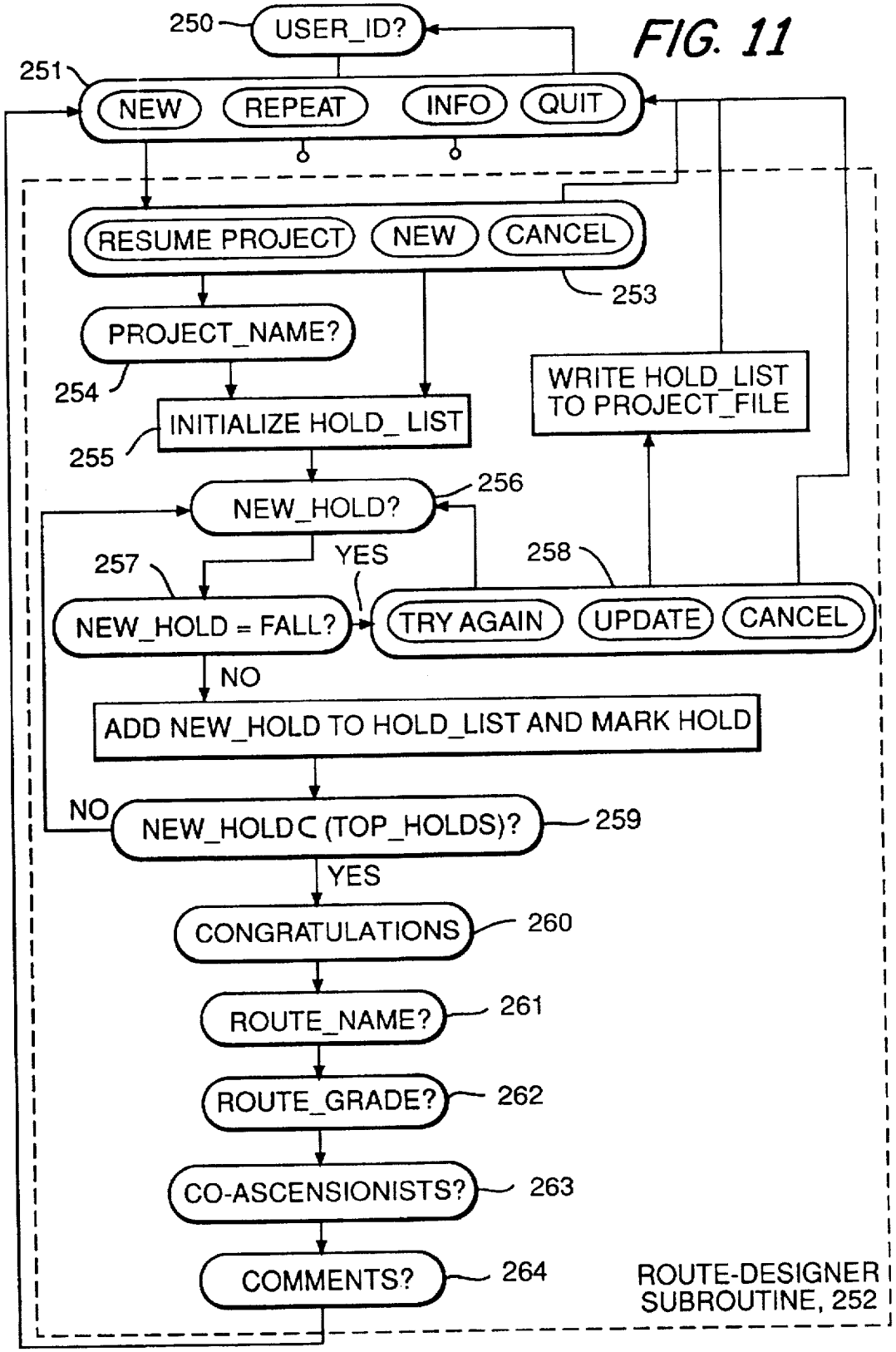
FIG. 11 is a schematic diagram depicting a control program subroutine illustrative of the invention.

FIG. 11 is a schematic diagram depicting the flow of control of a route design handling subroutine illustrative of the invention. A climber wishing to use the apparatus first enters his name which the program places in a user id variable 250. The program then displays a main menu 251, which offers the climber the choice of: designing a new route ('new'), repeating an existing route ('repeat'), requesting information ('info'), or quitting ('quit'). If the climber chooses 'new,' then the program calls the 'route designer subroutine' 252, which displays a route designer sub-menu 253, offering the climber the choice of resuming work on an existing project, beginning a new project, or returning to the main menu 251.

An 'existing project' refers to a pre-recorded sequence of holds which no climber has yet succeeded in ascending. If the climber selects this choice, then the subroutine 252 displays a list of the names and 'anticipated grades' of the available projects which are associated with the user's name in the computer's database. This list may include both projects recorded by the user himself, and projects recorded by other climbers and made available for public use. When the user selects a project from the list, the subroutine 251 stores its name in the project-name variable 254 and opens the corresponding data file which lists the project's hold addresses. The subroutine reads these addresses into the 'hold list' array variable 255 and activates the appropriate hold markers, by transmitting to the control circuit 90 of FIG. 4 the reset command followed by the list of hold addresses. Alternately, if the climber selects 'new' from the route-designer sub-menu 253, then the program initializes the hold list to zero and simply transmits the reset command. In either case, the climber is then free to climb.

The subroutine 252 then repeatedly polls the electronic circuit 90 of FIG. 4 for either the address of a new-hold, or the fall detection address as shown by the new hold box 256. When the program receives an address from the control circuit 90 of FIG. 4, it first compares it to the address of the fall detector as shown by box 257.

If a fall is detected, then a menu 258 is displayed giving the climber the option of trying again, updating the project file, or returning to the main menu 251. If the user chooses to update after recalling an existing project using menu 253, then the hold list of that project file is simply over written with the new hold list. If the user chooses to update after having chosen 'new' from menu 253, then he is asked to provide a project name and anticipated grade, and a new project file is created.

If a fall is not detected at box 257, then the subroutine, 252 adds the address of the new hold to the hold list array variable 255 and turns on the appropriate hold marker. The subroutine 252 then checks whether the new-hold is on a list of top holds at box 259. If it is then a congratulatory message 260 is displayed, and the climber is asked to provide a route-name 261, assign a route grade 262, list the names of any co-ascensionists 263, and record any pertinent comments 264. This information is then written to a new data file, along with the user-id, time and date, and program control is returned to the main menu 251.

If the new hold is not on the list of top-holds at box 259, then control is returned to the new-hold box 256 and the process is repeated until the climber either falls or grabs a top-hold.

Route-Repeater

FIG. 12 is a schematic diagram depicting the flow of control of a route repetition handling subroutine illustrative of the invention. A climber wishing to use the apparatus first enters his name which the program places in a user id variable 350. The program then displays a main menu 351 which offers the climber the choice of: designing a new route ('new'), repeating an existing route ('repeat'), requesting information ('info'), or quitting ('quit'). If the climber chooses 'repeat,' then the program calls the 'route repeater subroutine' 352, which determines the user's rating and assigns it to a variable user-rating 353. The subroutine 352 then displays a list of routes available each having a grade at or near the user's rating as indicated by box 354 and waits for the user to select one using menu 355. If the user chooses 'cancel' from the menu 355 then the subroutine 352 returns control to the main program's menu 351. If the user specifies an available route, then the subroutine 352 queries the user whether he wishes his score displayed. If the climber responds yes, then a scoreboard as in FIG. 2 is activated.

The subroutine 352 then initializes the climbers score to zero, and marks the route on the wall as in FIG. 2 by sending the addresses of the route's holds to an electronic circuit such as that of FIG. 4.

Once the route is marked, the subroutine 352 repeatedly polls the electronic circuit 90 of FIG. 4 an address as shown by the new hold box 356. When the control circuit 90 of FIG. 4 returns an address, the subroutine 352 first compares it to the address of the fall detector of FIGS. 3 and 4 as shown by box 357. If the address matches that of the fall detector, then the subroutine 352 updates the user's data record, recording the name of the route and the height and time at which he fell, as indicated by boxes 358 and 359.

If the address received from the control circuit is not that of the fall detector, then the subroutine 352 checks to see if the hold address is on the list of holds for the selected route as indicated by box 360. If it is not, then the subroutine 352 updates the user's data record, recording the name of the route and the height and time at which he went 'off-route,' as indicated by boxes 358 and 362.

If the hold address is on the list of holds for the selected route at box 360, then the subroutine 352 increments the user's score as indicated by box 361. The subroutine 352 then checks to see if the hold address is on a list of top or final holds for the route as indicated by box 363. If it is not then control passes back to box 356 and the subroutine 352 polls the control circuit for a new address.

If the hold address at box 363 is on a list of top or final holds for the route as indicated, then a congratulatory message 364 is displayed, and the climber is asked to enter a quality appraisal 365 and grade 366 for the route. The subroutine 352 then updates the route's data record using this information as indicated by box 367. The user's data record is also updated to include a record of his successful ascent.

It will thus be seen that the invention efficiently attains the objects set forth above, in particular providing an apparatus for automatically recording a sequence of selected holds comprising a new route; for rapidly recalling and displaying routes previously climbed; and for scoring a climber's performance in ascending a displayed route.

It will be understood that changes may be made in the above construction and in the foregoing sequences of operation without departing from the scope of the invention. For example, electronic circuits other than those shown on FIGS. 4, 5*a*, and 6, and computer programs other than the one diagrammed on FIGS. 10, 11, and 12 may be used to control the hold markers while not deviating from the general concept of a system for automatically recording and marking routes on an artificial climbing wall and for scoring and rating the performance of climbers using these routes.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims. It is accordingly intended that all matter contained in the above description or shown in the accompanying drawings be interpreted as illustrative rather than in a limiting sense.

It is also to be understood that the following claims are intended to cover all the generic and specific features of the invention as described herein, and all statements of the scope of the invention which, as a matter of language, might be said to fall therebetween.

What is claimed is:

1. An apparatus for recording and marking routes on an artificial climbing structure having a plurality of holds, said apparatus comprising:

a computer;

a plurality of sensors connected to said computer, each of said sensors being associated with one of said holds; and a plurality of hold markers, each of said hold markers being located adjacent to one of said holds, wherein each of said sensors is mounted on said artificial climbing structure, and wherein each of said sensors comprises a switch located behind the associated hold.

2. The apparatus of claim 1, wherein each of said sensors comprises a means for detecting motion of the associated hold when weighted by a climber.

3. The apparatus of claim 1, further comprising a plurality of switches, each of said switches being connected to one of said hold markers for controlling said one of said hold markers.

4. The apparatus of claim 3, wherein said switches are located adjacent to one of said hold markers for controlling said one of said hold markers.

5. The apparatus of claim 2, wherein said computer is connected to each of said hold markers for controlling said hold markers.

6. The apparatus of claim 2, further comprising:

a matrix circuit connecting said sensors and said hold markers to said computer.

7. The apparatus of claim 5, wherein each of said hold markers is located to a side of the associated hold.

8. The apparatus of claim 7, further comprising a route completion detector connected to said computer.

9. The apparatus of claim 8, further comprising a fall detection sensor connected to said computer.

10. The apparatus of claim 2, wherein said computer comprises a means for storing a sequence of holds constituting a route.

11. The apparatus of claim 10, wherein said computer further comprises a means for providing power to said hold markers associated with said sequence of holds constituting a route.

12. An apparatus for recording and marking routes on an artificial climbing structure having a plurality of holds, said apparatus comprising:

a computer;

a plurality of switches, each of said switches being associated with one of said holds and being located behind said one of said holds; and a plurality of lights connected to said computer, each of said lights being located to a side of one of said holds;

wherein said computer comprises a means for electronically storing a sequence of holds constituting a route and a means for providing power to said lights associated with said sequence of holds constituting a route.

13. The apparatus of claim 12, further comprising a route completion detector connected to said computer.

14. The apparatus of claim 13, wherein said computer further comprises a means for scoring a climber's performance.

15. The apparatus of claim 14, further comprising a fall detection sensor connected to said computer.

16. In an apparatus comprising a computer including a data storage device, an artificial climbing structure having a plurality of holds, and a plurality of hold markers associated with said holds, a method for recording climbing routes, said method comprising the steps executed by said computer of:

detecting motion of one of said holds when weighted by a climber; and storing a location of said one hold in a data file of said data storage device.

17. In an apparatus comprising a computer including a data storage device, an artificial climbing structure having a plurality of holds, and a plurality of hold markers associated with said holds, a method for recording climbing routes, said method comprising the steps executed by said computer of:

detecting motion of one of said holds when weighted by a climber;

storing a location of said weighted hold in a data file of said storage device; and powering said hold markers associated with said weighted hold stored in said data file.

18. The method of claim 17, further comprising the step of calculating a score of a climber's performance and displaying said score.

19. A climbing gym comprising:

an artificial climbing structure;

a plurality of holds attached to said artificial climbing structure;

a computer;

a plurality of sensors connected to said computer, each of said sensors being attached to said artificial climbing structure and associated with one of said holds;

a plurality of hold markers connected to said computer, each of said hold markers being attached to said artificial climbing structure and located adjacent to one of said holds; and means for preventing said holds from spinning on said artificial climbing structure, wherein there are a plurality of holes in said holds, and wherein said means for preventing said holds from spinning comprises a plurality of pins attached to said artificial climbing structure, each of said pins engaging one of said holes in said holds.

* * * * *